US005421139A

United States Patent [19]

Tolson

[11] Patent Number: 5,421,139

[45] Date of Patent: Jun. 6, 1995

[54] METHOD OF MAKING A FILM WRAPPED PRODUCT HAVIN AN OFF-CENTER SEAM

[75] Inventor: Sidney S. Tolson, Scotland Neck, N.C.

[73] Assignees: Ossid Corporation, Rocky Mount, N.C.; Ibaraki Seiki Machinery Company, Ltd., Osaka, Japan

[21] Appl. No.: 225,822

[22] Filed: Apr. 11, 1994

[51] Int. Cl.[6] ..... B65B 51/16; B65B 11/22

[52] U.S. Cl. ..... 53/441; 53/450; 53/463; 53/547; 53/556; 53/229; 53/550; 53/374.4

[58] Field of Search ..... 53/441, 442, 450, 451, 53/463, 466, 229, 550, 551, 552, 556, 557, 374.4, 375.9, 376.2, 386.1, 547, 415

[56] References Cited

U.S. PATENT DOCUMENTS

| | | | |
|---|---|---|---|
| 3,753,331 | 8/1973 | Sato | 53/386.1 X |
| 3,973,372 | 8/1976 | Omori | 53/441 |
| 4,430,844 | 2/1984 | James | 53/550 X |
| 4,483,125 | 11/1984 | Suga | 53/450 |
| 4,715,166 | 12/1987 | Kameda | 53/374.4 X |
| 4,761,937 | 8/1988 | Francioni | 53/450 X |
| 4,841,715 | 6/1989 | Suga | 537/547 |
| 5,255,497 | 10/1993 | Zoromski et al. | 53/551 |
| 5,269,119 | 12/1993 | Tolson | 53/550 X |
| 5,282,349 | 2/1994 | Siegel | 53/450 X |
| 5,329,745 | 7/1994 | Suga | 53/450 X |
| 5,367,859 | 11/1994 | Suga | 53/550 |

*Primary Examiner*—Horace M. Culver
*Attorney, Agent, or Firm*—Olive & Olive

[57] ABSTRACT

A method of producing a film wrapped package enables the package to have a bottom seam which is offset from the center-line of the tray and thus lends itself to pre-printing relatively large labels on the bottom of the package without interference from the bottom seam.

6 Claims, 3 Drawing Sheets

METHOD OF MAKING A FILM WRAPPED PRODUCT HAVIN AN OFF-CENTER SEAM

RELATION TO THIS APPLICATION TO A CO-PENDING APPLICATION

This application relates to pending design patent application Ser. No. 29/017,168, filed Jan. 6, 1994, entitled FILM-WRAPPED PRODUCT FILLED TRAY HAVING OFFSET BOTTOM SEAL.

BACKGROUND OF THE INVENTION

1. Field of the Invention

The invention disclosed relates broadly to packaging, particularly to film wrapped product packages such as film wrapped trays of poultry and more specifically to a method of forming the bottom seams of such packages to accommodate labeling of the packages.

2. Description of the Related Art

It is known to wrap products in transparent, plastic heat shrinkable film and then to shrink the film so as to protect the product and display it in a commercially attractive manner. In the initial process of wrapping, the longitudinal edges of the film are typically sealed to form a seam on the bottom of the product package and which extends along a line that is parallel to the conveyor path and that coincides with the central longitudinal vertical plane passing through both the conveyor and the product package. The width-wise extending edges of the film at each end of the product package are also sealed across the width of the package to form a seam which extends perpendicular to the conveyor path. To make this film wrap commercially attractive, heat is applied to the film to cause it to shrink and achieve intimate wrinkle-free contact with the product package.

A horizontal package, wrapping apparatus which is representative of the art is taught in U.S. Pat. No. 4,841,715. The apparatus of the '715 patent includes a conveyor, a film feed fed from a film supply, a pair of converging belts, a pair of side belts and a pair of sealing rollers symmetrically arranged so as to film wrap a product package as described above. The central, longitudinal, vertical plane of the package wrapping apparatus also normally constitutes the central, longitudinal vertical plane of the conveyor, film feed, gripper chains, converging belts, side belts and sealing rollers and consequently the bottom seam of the package is centered widthwise on the bottom of the tray.

The conventional film wrapped product package has a smooth top surface ideal for placement of the producer's name and logo. However, the bottom surface is conventionally divided into two small substantially equal size surfaces by the ungainly center-line seam, thus making the bottom surface less than ideal for placement of large readable information labels. The inadequate labeling space available and the unattractive nature of the bottom surface of the product package often causes the producer to abandon placement of informational labels on the bottom surface altogether.

Recently enacted United States Department of Agriculture (USDA) meat packaging labeling directives have increased the importance of the bottom surface of meat product packages for receiving readable information labels thereon. The new USDA directives require, in general, that each retail package containing a meat product be labeled with safe cooking and handling instructions to enhance the consumer's knowledge concerning storage, preparation, cooking and preservation of leftovers. This new directive further requires that the instructions be readable and that the direction of print on the top of the package be the same as on the bottom of the package. In response to this directive and for reasons of appearance and economy, it has been found desirable to pre-print the information label on the film rather than on a separate label. Traditionally, the central longitudinal axis of the wrapping film is used as a spatial reference for symmetrical placement of print on the film prior to wrapping the product in the film.

The acceptable areas for receiving an instruction panel are the bottom and top surfaces of the film-wrapped package. However, producers of the product contained in the package typically reserve the top surface for placement of "catchy" slogans, logos and design elements to entice a consumer to inspect and purchase the enclosed product. Unobstructed transparent film areas are also required in a film wrapped package so consumers can inspect the product contained therein. Therefore, substantial amounts of textual material, such as safe handling instructions, are typically placed on the bottom surface of the film wrapped package. As stated above, the current film packaging practice creates a film wrapped product package with a bottom seam that coincides with the product bottom surface longitudinal center-line. A safe handling information label of adequate size when placed on the bottom of a conventionally film wrapped package is caused to be divided by this seam into two separate information fragments. As a result, a consumer may find the bottom of the package cluttered and unappealing and thus decide not to read the label at all, or may think that the safe handling instructions are fully contained in only one of the fragments and not read the fragment containing the remainder of the safe handling instructions.

A method of packaging which would permit an increase in the label receptive surface area of the bottom surface of a film wrapped meat package would signify a significant improvement in meat product technology. Such an additional surface area could, for example, be used for advertisement of the product and for placement of a USDA safe handling instruction label that complies with USDA directives without compromising the attractiveness of the product package front surface where traditional product and trademark information is typically placed. However, the conventional product packaging method and apparatus are not adapted to wrap a product package so as to form a bottom seam offset from the central longitudinal axis of the bottom surface of a film wrapped product package, and thus do not provide a product package bottom surface capable of receiving large attractive labels, in particular, USDA required safe handling instructions for meat product packages. In addition, the symmetrical placement of pre-printed labels on film according to current practice does not permit pre-printed labels to be placed in proper relationship to the top and bottom surfaces of a film wrapped product package having a bottom seam offset from the product package bottom surface longitudinal center-line.

It is therefore an object of this invention to provide a product package having a bottom seam offset from and parallel to the longitudinal center-line of the bottom surface of the package so as to provide a large unobstructed area on the bottom surface for large labels and attractive design elements, and adequate unobstructed space for USDA required safe handling instructions.

It is a further object of this invention to provide a method in which selected components of the '715 patent type product packaging apparatus are asymmetrically displaced with respect to the central longitudinal vertical plane of the product packaging apparatus so as to produce a film wrapped product package having a bottom seam offset from and parallel to the center-line of the bottom surface of the product package.

It is also a further object of this invention to provide a method for proper placement of labels on the film wrap prior to wrapping a product package with such film wrap so as to be able to locate a large, readable label, such as the USDA required safe handling instruction label, on the bottom surface of a product package having a bottom seam offset from the location of the label and offset from the product package bottom surface center-line.

Other objects and advantages will be more fully apparent from the following disclosure and appended claims.

SUMMARY OF THE INVENTION

The present invention provides a product package enclosed in transparent, heat sealed film having a bottom seam in a location off-set from and parallel to the product package bottom surface center-line and a method for making such a package. The bottom seam divides the film on the bottom surface of the product into large and small surface areas. The large surface area may be conveniently used to place a readable pre-printed USDA required safe cooking and handling instruction. The small area also becomes conveniently available for an appropriate recipe, other pre-printed informational labels and design elements. The present invention is also directed to operating a conventional product packaging apparatus in a manner such that selected components such as the conveyor, film feed, gripper chains, and side belts or alternatively, the converging belts and sealing rollers are offset from the central longitudinal vertical plane of the apparatus. Operating the packaging apparatus with the asymmetric arrangement of its components result in producing a film wrapped product package having a bottom seam offset from the product package bottom surface center-line so as to provide a large surface area on the bottom of the package for placement of a large readable label, such as the USDA required safe cooking and handling instruction label. The invention also provides a method for proper alignment and printing of labels on the film wrap prior to wrapping the product and which is compatible with having an offset bottom seam such that in the finished package, the pre-printed labels are in proper relationship to the top and bottom surfaces of the film wrapped product package for optimum attractiveness and readability.

DETAILED DESCRIPTION OF THE INVENTION AND PREFERRED EMBODIMENTS THEREOF

Figure 1:
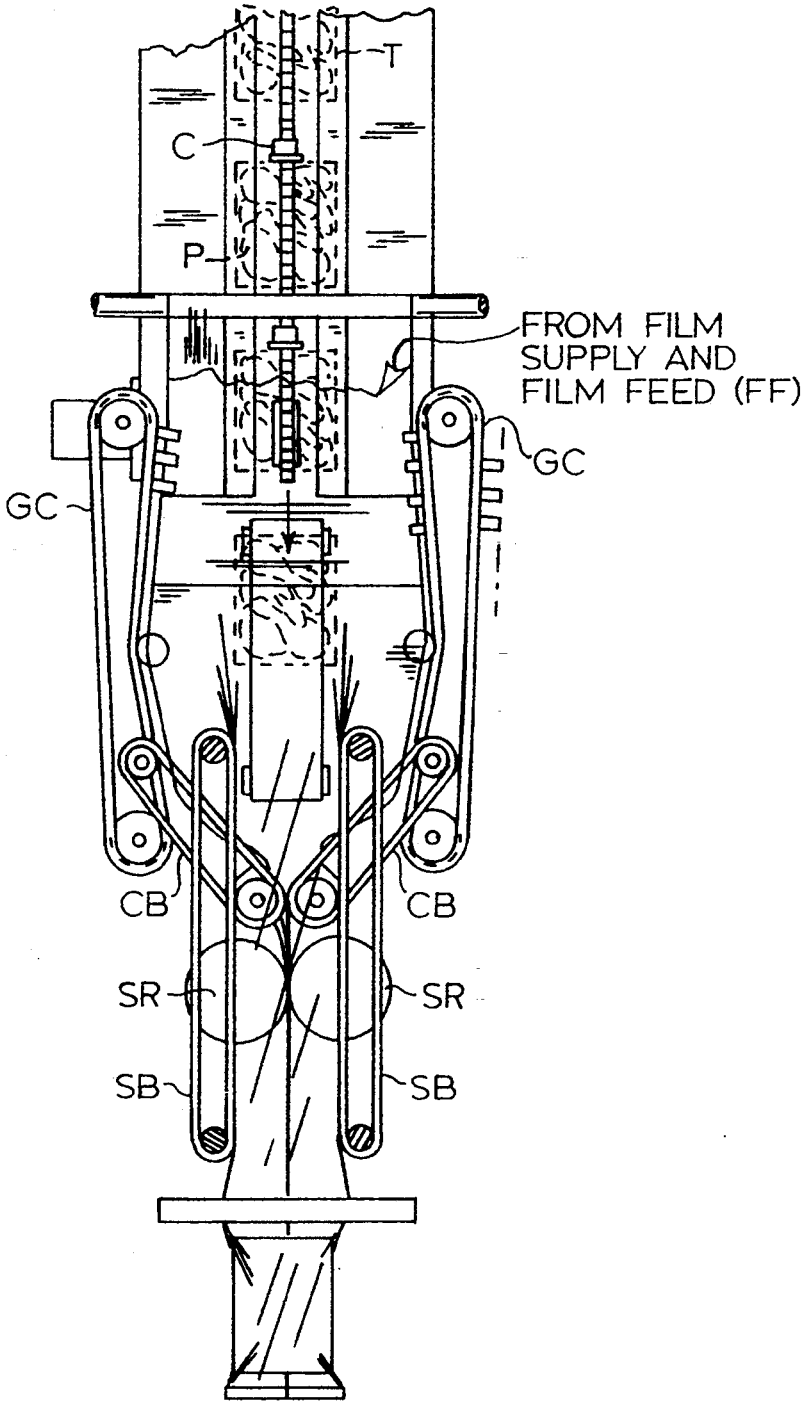
PRIOR ART FIG. 1
FIG. 1 is a top plan view of a portion of a '715 patent type machine for wrapping a product filled tray with a flexible film according to the prior art.

The present invention is directed to providing a film wrapped product package having a bottom seam located offset from and parallel to the product package bottom surface center-line. The purpose of the off-set bottom surface center seam is to divide the product package bottom surface into large and small surface areas. The large bottom surface area is particularly adapted to receive a large readable label, in particular the safe cooking and handling instruction now required to be included by the USDA on all meat product packages and referred to in the drawings as "Handling Instructions".

A film wrapped product package 10 according to the invention comprises a product P supported by a product tray T as illustrated in FIGS. 3–7. The film wrapped package 10 includes pre-printed labels located thereon and schematically represented by the relatively large top rectangular surface area within box 12 labelled "Producers Name/Logo" by way of example, the relatively large bottom rectangular surface area within box 15 labelled "Handling Instructions" by way of example, and the relatively small bottom rectangular surface area within box 16 labelled "Recipe" by way of example. The top surface area 12 of product package P provides a continuous, smooth relatively large surface upon which "eye-catching" logos and advertisements may be located. Substantial transparent surface areas 14 and 18 provide the consumer an opportunity to visually inspect the product contained therein.

Figure 4:
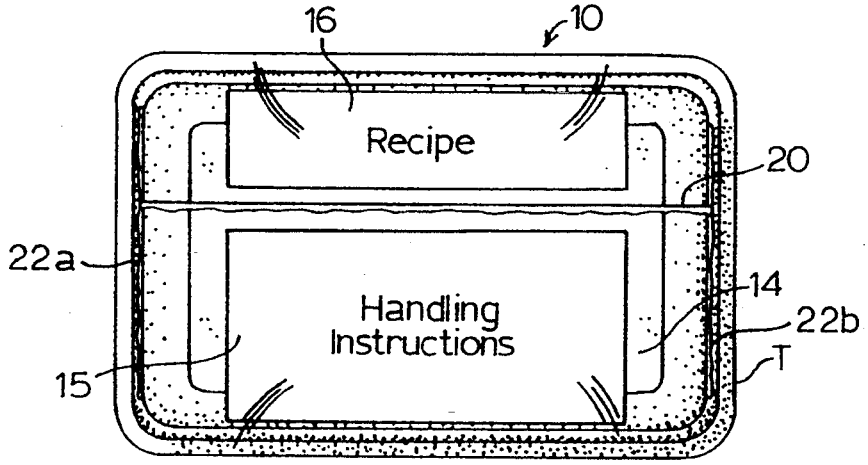
FIG. 4 is a bottom plan view of the film wrapped product package of FIG. 3 showing its bottom seam offset from the product bottom surface center-line according to the invention and with a relatively large and a relatively small pre-printed bottom surface areas schematically illustrated by the illustrated rectangular box outlines and bearing the illustrative labels "Handling Instructions" and "Recipe".
Figure 5:
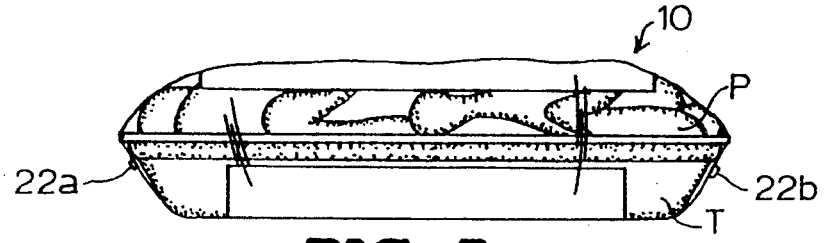
FIG. 5 is a side view of the film wrapped product package of FIG. 3.
Figure 7:
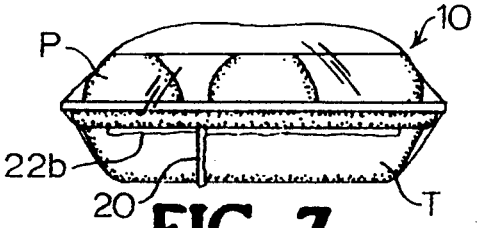
FIG. 7 is an end view of the film wrapped product package of FIG. 3 taken in the direction of line 7—7 of FIG. 3.

As depicted in FIG. 4, bottom seam 20 extends along the bottom surface 14 of film wrapped product package 10 in a line that is parallel to and offset from the center-line of the bottom surface and permits forming a first bottom surface area defined by the rectangular box 15 and a second bottom surface area defined by the rectangular box 16. First bottom surface area 15 contains more surface area than second bottom surface area 16 for placement of a sufficiently large and readable USDA required safe cooking and handling instructions. The remaining available bottom surface areas are suitable for placement of other various informational labels and designs. Each end of the product package 10 is sealed to form a pair of seams 22*a*, 22*b* oriented perpendicular to bottom seam 20 as shown in FIGS. 5 and 7. The present invention thus provides an offset bottom seam on the bottom surface of a film wrapped product package 10 in a form suitable to being designed so as to attract consumer attention and to encourage consumers to read the information contained thereon.

Figure 8:
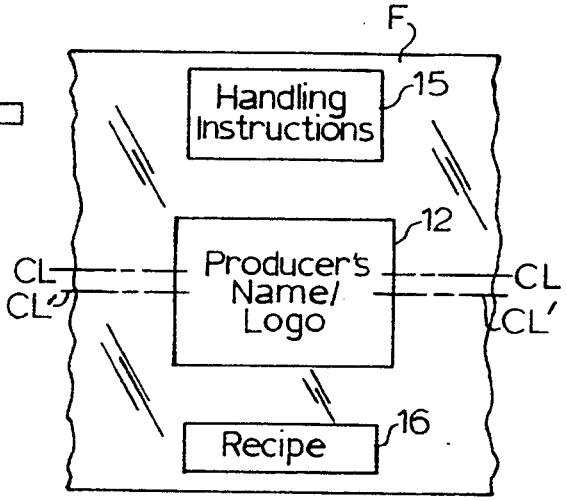
FIG. 8 is a partial plan view of a section of film showing the illustrative pre-printed labels.
Figure 3:
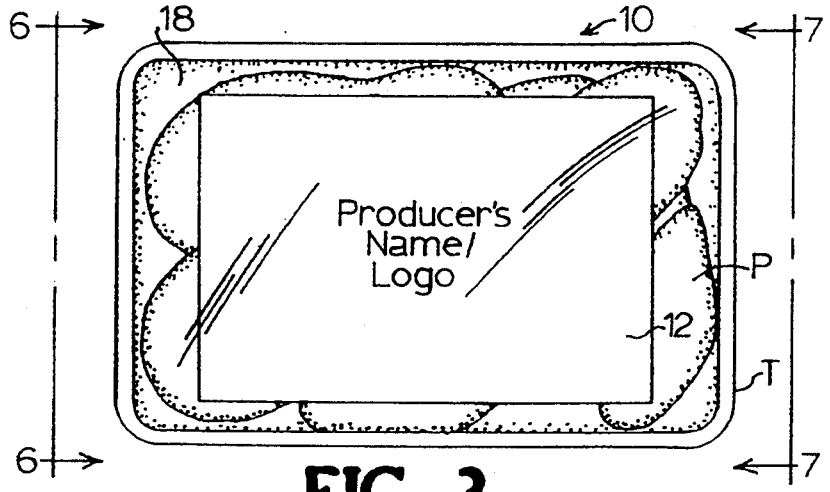
FIG. 3 is a top plan view of a film wrapped product package filled with poultry parts according to the invention and with a large, pre-printed top surface area schematically represented by the illustrated rectangular box outline and bearing the illustrative label "Producers Name/Logo".

As depicted in FIG. 8 in which a short section of film F is shown, the film F is produced with the described top 12 and bottom 15, 16 surface areas already preprinted and in the proper orientation. Also to be noted is that according to the invention, the longitudinal center-line CL of the film F is offset from the longitudinal center-line CL′ of the rectangular top surface area 12.

The present invention is also directed to a method for making the above described film wrapped product package 10. A packaging apparatus representative of the state of the art is described in the '715 patent, the teachings of which are incorporated herein by reference, and is schematically illustrated in FIG. 1. A product wrapping apparatus such as described in the '715 patent includes a conveyor C for feeding individual product filled trays T in spaced apart relation, a film feed FF, a pair of gripper chains GC, a pair of converging belts CB, a pair of side belts SB and a pair of sealing rollers SR symmetrically arranged so as to produce a film wrapped product package having a bottom seam which is located on the bottom surface of the package and coincides with both the product bottom surface center-line and the central, longitudinal vertical plane of the packaging apparatus. As seen in FIG. 1, the pair of opposed gripper chains GC travel along opposite sides of the product conveyor C and a product containing tray T which is one of a sequence of trays is placed upon the product conveyor C. As further explained in the '715 patent, each chain GC carries a plurality of film grippers or clamps adapted to be opened and closed in a manner to grasp longitudinal edges of the packaging film F. The gripper chains GC are configured so as to carry the film edges along a path generally converging and descending in relation to the product conveyor C so that the film F forms a tube surrounding each product containing tray T on the conveyor C. The pair of converging so-called "wing plate" mounted driven friction belts CB continue transport of the tubular film F forwardly and inwardly so as to mate the longitudinal film edges directly underneath the bottom surface of the product tray T. The sealing rollers SR, having a centrally located sealing portion coinciding with the central longitudinal vertical plane of the packaging apparatus are positioned to heat seal the edges of film together to form a bottom seam that according to conventional practice coincides with the product bottom surface center-line and thus does not accommodate to printing the required USDA label on the bottom surface.

The product packaging apparatus 30 of the present invention includes those previously described components of the described '715 patent apparatus but in a different asymmetric configuration adapted to produce the previously referred to film wrapped product package 10 having a bottom seam 20 on its bottom surface but offset from and parallel to the bottom surface center-line of product package 10.

Figure 2:
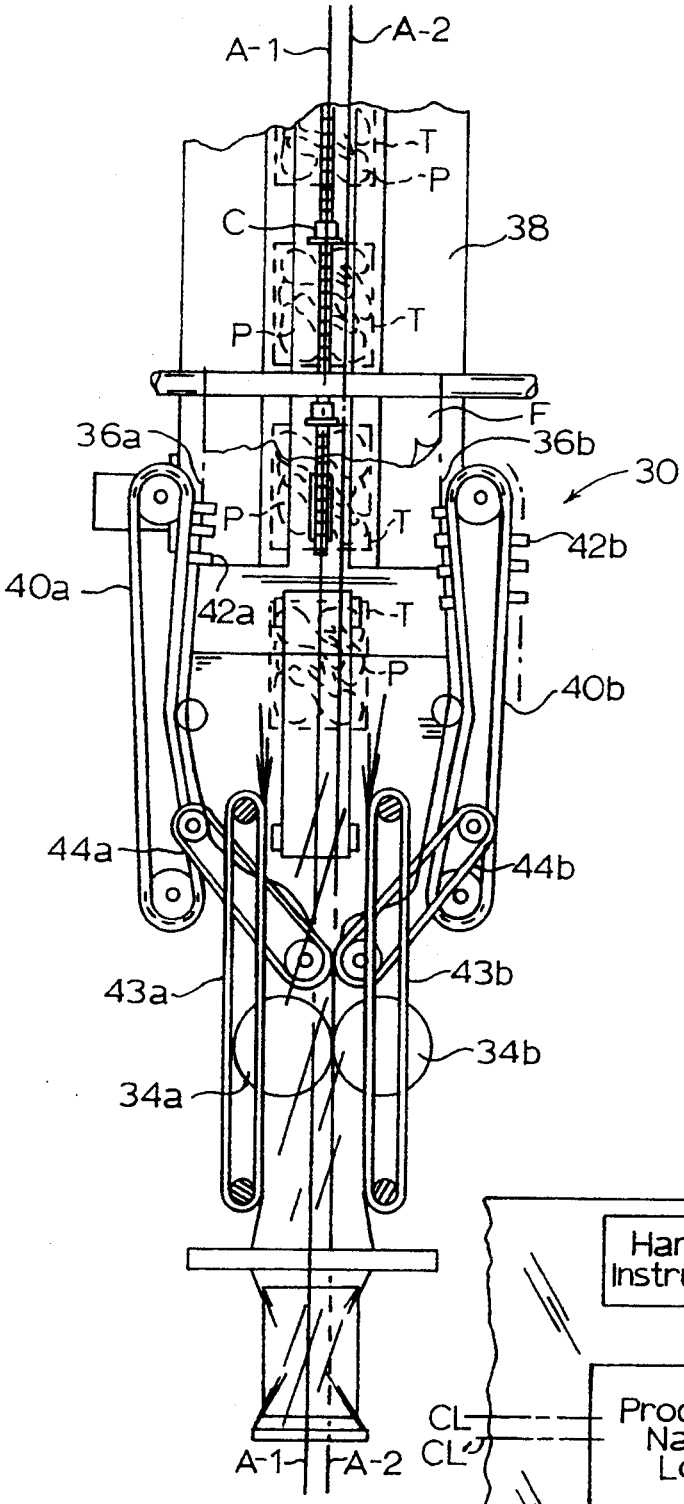
FIG. 2 is a top plan view of a portion of the machine of FIG. 1 adjusted for wrapping a product filled tray with a flexible film according to a first embodiment of the invention.

Making further reference to FIG. 2, the product packaging apparatus 30 while generally following the construction described in the '715 patent includes a laterally adjustable, horizontal central conveyor 38 with means to sequentially feed each product filled tray T into the film F drawn from a film supply through a suitable film feed, not shown. Conveyor 38 is straddled by a pair of gripper chains 40*a*, 40*b* and converging wing plate mounted driven friction belts 44*a*, 44*b* followed by driven side belts 43*a*, 43*b*. Grippers 42*a*, 42*b* are integral to chains 40*a*, 40*b* respectively and separate in the manner set forth in the '715 patent. Sealing rollers 34*a*, 34*b* are located so as to seal the film edges and form a bottom seal on each successive package. The central longitudinal vertical plane of the product packaging apparatus 30 coincides with axis A-2 and passes between and centrally of the converging belts 44*a*, 44*b* and sealing rollers 32*a*, and 32*b*.

Prior to operating the product packaging apparatus 30 of the invention, to produce the previously described film wrapped package 10, the film feed, not shown, and the conveyor 30 are laterally adjusted such that each tray T with its product P approaches the film wrapping station with the center-line CL (FIG. 8) of the film F and the center-line of the bottom surface of the tray T coinciding with an axis A-1 that resides in a longitudinal vertical plane that is offset but parallel to the central longitudinal vertical plane of the product packaging apparatus 30 and coinciding with axis A-2. The gripper chains 40*a*, 40*b* are also adjusted laterally so as to have the central longitudinal vertical plane of the gripper chains coincide with the previously mentioned offset axis A-1. In a similar manner, the side belts 43*a*, 43*b* are also laterally adjusted so as to have the central longitudinal vertical plane of the side belts coincide with the offset axis A-1. The converging wing plate mounted belts 44*a* and 44*b* as well as the sealing rollers 34*a*, 34*b* are left in their normal position and are centered on longitudinal vertical plane coinciding with the axis A-2. Prior to commencing the packaging operation, the machine 30 is loaded with the film F pre-printed with the previously referred to top surface area 12 and bottom surface areas 15, 16 and which are offset from the center-line CL of the film F as schematically illustrated in FIG. 8.

Each product P supported by a tray T is fed in sequence into an infeed end of the central conveyor 38 and is aligned in the apparatus 30 such that the longitudinal center-line of the bottom surface of each tray T coincides with the reference longitudinal axis A-1 and is thus offset from but is oriented parallel to the longitudinal reference axis A-2 of packaging apparatus 30, as viewed in FIG. 2.

Figure 6:
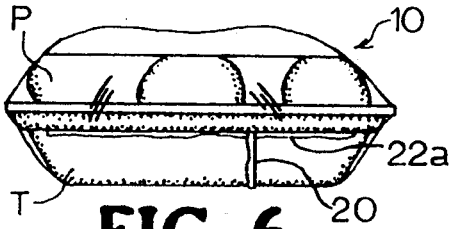
FIG. 6 is an end view of the film wrapped product package of FIG. 3 taken in the direction of line 6—6 of FIG. 3.

Film F having longitudinal edges 36*a*, 36*b* and a central longitudinal axis CL (FIG. 8) is supplied to apparatus 30 through a film feed (not shown) from a supply roll (not shown). Film F is positioned to overlie each tray T with the central longitudinal axis CL of the film offset from the central longitudinal reference axis A-2 of the apparatus 30. The chains 40*a*, 40*b* and grippers 42*a*, 42*b* are configured so as to carry the longitudinal edges 36*a*, 36*b* of the film F along a path generally converging and descending in relation to conveyor 38 so that film F forms a tube surrounding tray T and product P therein located on conveyor 38. Grippers 42*a*, 42*b* transfer control of film F to the converging wing plate mounted friction belts 44*a*, 44*b*. Converging friction belts 44*a*, 44*b* reside below the level of the conveyor and carry the longitudinal edges 36*a*, 36*b* of film F forwardly and inwardly so as to mate edges 36*a*, 36*b* directly beneath the product package 10 in a line that coincides with the central longitudinal vertical plane coinciding with axis A-1 of the packaging apparatus 30. The longitudinal edges 36*a*, 36*b* are sealed together as they pass through sealing rollers 34*a*, 34*b* to form the offset seam 20 as best shown in FIGS. 4, 6 and 7. At this stage, the side drive belts 43*a*, 43*b* positioned above the level of the conveyor 38 grasp and move the product package 10 to further end seal, film cutting and processing stations as is known.

In a second embodiment, not shown, the components selected to be laterally shifted are the converging belts 44*a*, 44*b* and sealing rollers 34*a*, 34*b* and it is these components that are shifted so as to reside in symmetrical relation with regard to the offset reference axis A-1, while the other components i.e. the gripper chains 40*a*, 40*b*, and side belts 43*a*, 43*b* remain centered with respect to the central longitudinal reference axis A-2 of the packaging apparatus 30. In both embodiments, the film F is pre-printed such that when the offset bottom seam 20 is formed, the top surface area 12 is centered on the package and the respective bottom surface areas 15, 16 are caused to reside on opposite sides and clear of bottom seam 20.

While the invention has been described with reference to specific embodiments thereof, it will be appreciated that numerous variations, modifications, and embodiments are possible, and accordingly, all such variations, modifications, and embodiments are to be regarded as being within the spirit and scope of the invention.

What is claimed is:

1. A method of producing an offset bottom seam in the course of wrapping film around a product in a tray utilizing a packaging apparatus having a laterally adjustable conveyor with means to feed a sequence of product filled trays in sequence, a laterally adjustable film feed fed by a film supply, a pair of laterally adjustable gripper chains disposed on opposite sides of the path of transport of the tray supported product being wrapped and operative to clamp edge portions of the film and place the film over the tray supported product being wrapped, a pair of converging belts disposed on opposite sides of the said transport path, terminating downstream of said gripper chains, and operative to grasp edge portions of the film preparatory to being sealed, and sealing rollers for heat sealing said edge portions to form a bottom seam extending lengthwise of the bottom of the wrapped tray supported product, said conveyor, film feed, gripper chains, converging belts and sealing rollers normally being disposed such that a first longitudinal central vertical plane of said apparatus comprises the longitudinal central vertical plane passing through said conveyor, film supply, gripper chains, converging belts, sealing rollers and bottom seam, said method of producing said offset bottom seam comprising:

(a) laterally positioning said conveyor, film feed and gripper chains so as to be centered with respect to a second longitudinal central vertical plane offset to one side of and parallel to said first longitudinal central vertical plane while said converging belts and sealing rollers remain centered with respect to the said first longitudinal central vertical plane of said apparatus; and (b) sequentially feeding longitudinally spaced apart trays filled with a selected product into said apparatus whereby to permit each of said trays to be wrapped with said film and the said edges of said film to be secured beneath the bottom of each successive tray to be sealed together by said sealing rollers to produce a bottom longitudinal seam which extends along a line on the bottom surface of said tray coinciding with said first longitudinal vertical plane of said apparatus and so as to be offset from but parallel to a line coinciding with said second longitudinal vertical plane.

2. The method of claim 1 wherein said film is pre-printed in a first area corresponding to a selected top area of film on the finished film wrapped package and symmetrically arranged with respect to said second longitudinal central vertical plane, and is pre-printed in second and third areas corresponding to selected bottom second and third areas on the finished film wrapped package and disposed on opposite sides of said bottom seam.

3. A method of producing an offset bottom seam in the course of wrapping film around a product in a tray utilizing a packaging apparatus having a laterally adjustable conveyor with means to feed a sequence of produce filled trays in sequence, a laterally adjustable film feed fed by a film supply, a pair of laterally adjustable gripper chains disposed on opposite sides of the path of transport of the tray supported product being wrapped and operative to clamp edge portions of the film and place the film over the tray supported product being wrapped, a pair of converging belts disposed on opposite sides of the said transport path, terminating downstream of said gripper chains, and operative to grasp edge portions of the film preparatory to being sealed and sealing rollers for heat sealing said edge portions to form a bottom seam extending lengthwise of the bottom of the wrapped tray supported product, said conveyor, film feed, gripper chains, converging belts and sealing rollers normally being disposed such that a first longitudinal central vertical plane of said apparatus comprises the longitudinal central vertical plane passing through said conveyor, film supply, gripper chains, converging belts, sealing rollers and bottom seam, said method of producing said offset bottom seam comprising:

(a) positioning said conveyor, film feed, gripper chains, converging belts and sealing roller components such that selected of such components are aligned with respect to said first longitudinal central vertical plane and other components are aligned along a second longitudinal central vertical plane parallel to but laterally displaced from said first plane; and (b) sequentially feeding longitudinally spaced apart trays filled with a selected product into said apparatus whereby to permit each of said trays to be wrapped with said film and the said edges of said film to be secured beneath the bottom of each successive tray to be sealed together by said rollers to produce a bottom longitudinal seam which extend along a line parallel to but offset from the said first longitudinal central vertical plane of said apparatus.

4. The method of claim 3 wherein said other components comprise said converging belts and said sealing rollers.

5. The method of claim 3 wherein said film is pre-printed in a first area corresponding to a selected top area of film on the finished film wrapped package and symmetrically arranged with respect to said second longitudinal central vertical plane, and in second and third areas corresponding to selected bottom second and third areas disposed on opposite sides of said bottom seam.

6. The method of claim 5 wherein said film is preprinted in a first area corresponding to a selected top area of film on the finished film wrapped package and symmetrically arranged with respect to said second longitudinal central vertical plane, and in second and third areas corresponding to selected bottom second and third areas disposed on opposite sides of said bottom seam.

* * * * *